US005603860A

United States Patent [19]

Hohenbichler

[11] Patent Number: 5,603,860

[45] Date of Patent: Feb. 18, 1997

[54] IMMERSED CASTING TUBE

[75] Inventor: Gerald Hohenbichler, Enns, Austria

[73] Assignee: Voest-Alpine Industrieanlagenbau GmbH, Linz, Austria

[21] Appl. No.: 506,863

[22] Filed: Jul. 25, 1995

[30] Foreign Application Priority Data

Jul. 25, 1994 [AT] Austria ..... 1470/94

[51] Int. Cl.[6] ..... B22D 11/10; B22D 41/50

[52] U.S. Cl. ..... 222/607; 222/606; 164/437

[58] Field of Search ..... 164/437, 337; 222/606, 607; 266/236

[56] References Cited

U.S. PATENT DOCUMENTS

| | | | |
|---|---|---|---|
| 3,371,704 | 3/1968 | Astrov et al. | 164/437 |
| 3,888,294 | 6/1975 | Fastner et al. . | |
| 3,991,815 | 11/1976 | Fastner et al. . | |
| 3,995,682 | 12/1976 | Fekete et al. | 164/437 |
| 5,201,909 | 4/1993 | Von Wyl et al. . | |
| 5,297,612 | 3/1994 | Korpela et al. . | |

FOREIGN PATENT DOCUMENTS

| | | | |
|---|---|---|---|
| 4319195 | 12/1994 | Germany . | |
| 58-47545 | 3/1983 | Japan . | |
| 61-23558 | 2/1986 | Japan | 164/437 |
| 63-76752 | 4/1988 | Japan | 222/606 |
| 2-165851 | 6/1990 | Japan | 222/606 |
| 5-131250 | 5/1993 | Japan | 222/606 |
| 2000876 | 10/1993 | Russian Federation | 222/606 |
| 382461 | 6/1973 | U.S.S.R. | 164/437 |
| 1474878 | 5/1977 | United Kingdom . | |
| WO89/12519 | 12/1989 | WIPO . | |

*Primary Examiner*—J. Reed Batten, Jr.
*Attorney, Agent, or Firm*—Hill, Steadman & Simpson

[57] ABSTRACT

The tube for introducing a metal melt into a continuous casting mold having broad side walls and narrow side or end walls includes a tube section provided with lateral openings for the metal melt whose central axes substantially are oriented towards the narrow sides of the strand being formed in the mold and a bottom portion provided with a bottom opening for the metal melt. In order to ensure, at high casting rates, both a slight vertical depth of penetration of the metal melt supplied through the casting tube into a liquid core of the strand and a slight whirl formation on the meniscus, the bottom portion includes at least two bottom openings oriented obliquely towards the narrow sides of the strand so as to form at least two casting jets whose flow directions cross each other in a viewing direction extending perpendicular to the wide sides of the strand.

21 Claims, 2 Drawing Sheets

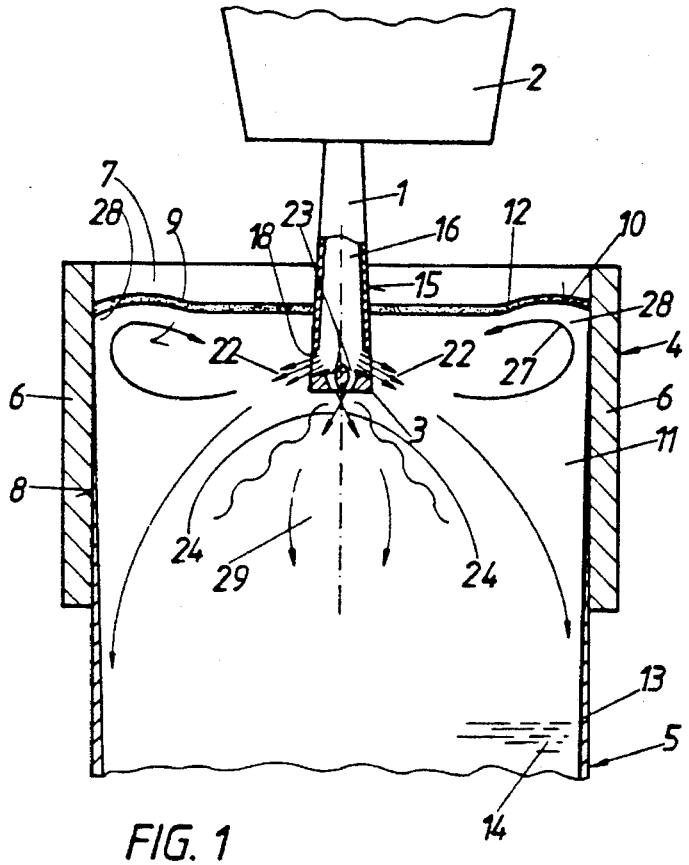
FIG. 1
FIG. 9
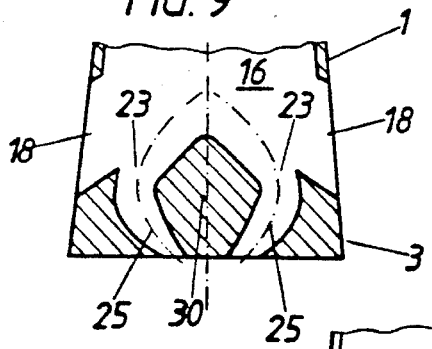
FIG. 10
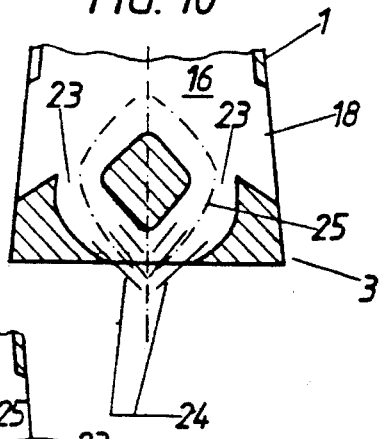
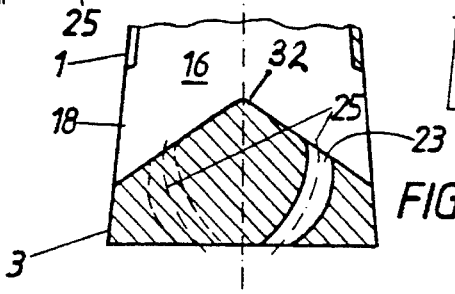
FIG. 11

III
II
IV
V
VI
VII
VIII
1
3
15
16
17
18
19
20
21
23
25
26
30
31
α
β
γ
ε

IMMERSED CASTING TUBE

BACKGROUND OF THE INVENTION

The invention relates to an immersed casting tube for introducing a metal melt, in particular a steel melt, into a continuous casting mold having wide side walls and narrow side or end walls and forming a strand with wide sides and narrow sides, in particular a thin-slab continuous casting mold, wherein the immersed casting tube comprises a tube section provided with lateral openings for the metal melt whose central axes are substantially oriented towards the narrow sides of the strand, and a bottom portion provided with a bottom opening for the metal melt.

High casting rates call for a high ejection speed of the casting jets emerging from the immersed casting tube. When using presently known immersed casting tubes, only a poor to medium product quality, i.e., quality of the strand, can thus be obtained. Due to melt flowing out of the immersed casting tube in the lateral directions, the meniscus of the melt is rather disturbed and uneven. On account of a downwardly directed melt flow, the melt can penetrate deeply into the interior of the strand. Not only will a partial remelting of the already solidified strand skin occur due to the newly arriving hot melt, but also the casting powder applied on the meniscus and impurities depositing on the meniscus will be entrained and flushed into the interior of the strand. If the melt emerging from the immersed casting tube primarily flows downwards, only a poor melting rate of the casting powder can be obtain, and the friction between the casting powder and the mold side walls will become undesiredly high.

Therefore, attempts have been made to positively influence the flow conditions within a strand by shaping casting tubes in a particular manner, and immersed casting tubes, which have both lateral openings and bottom openings, have been produced. Such immersed casting tubes of the initially defined kind are known, for instance, from AT-B-332,579; JP-A-58-47545 and AT-B-331,428. However, the above-described drawbacks could not be avoided with these known immersed casting tubes. In particular, it has not been possible to obtain acceptable qualities when casting thin slabs at high casting rates.

From WO89/12519 an immersed casting tube is known, in which two crossing or intersecting casting jets emerge from the bottom region or from the lateral region of the immersed casting tube. According to a further embodiment, casting jets cross or intersect each other in the interior of the immersed casting tube before emerging laterally. Also with these known immersed casting tubes, it is not feasible to meet the diverging demands of a high casting rate and a slight yet sufficient movement of the bath on the meniscus as well as a slight vertical depth of penetration of the casting jet into the liquid core of the strand.

SUMMARY OF THE INVENTION

The invention aims to avoid the above-described disadvantages and difficulties and has as an object to provide an immersed casting tube of the initially defined kind, by which both a slight vertical depth of penetration of the melt supplied through the immersed casting tube can be observed despite high casting rates and a slight formation of waves is noticeable on the meniscus on grounds of reduced lateral ejection pulses, i.e., a calm meniscus is ensured. In particular, the boundary wave forming on the meniscus during the casting operation is to be of a small height only while still attaining a sufficiently high melting rate for the casting powder covering the meniscus.

In accordance with the invention, this object is achieved in that the bottom portion comprises at least two bottom openings oriented obliquely towards the narrow sides of the strand so as to form at least two casting jets whose flow directions cross each other in a viewing direction perpendicular to the wide or broad sides of the strand.

According to a preferred embodiment, the casting jets emerging from the bottom openings intersect either in the region of the bottom portion, or at a distance below the bottom portion, of the immersed casting tube in a viewing direction perpendicular to the wide sides of the strand. It may be advantageous for certain mold cross sections and flow speeds if the casting jets intersect only with a partial region of their cross sections.

According to further preferred embodiment, the casting jets emerging from the bottom region cross each other in a skew manner either in the bottom region or below the bottom region at a distance therefrom.

Suitably, the central axes of the bottom openings enclose an angle of between 5° and 120°.

Preferably, the cross sections of the bottom openings comprise an area portion ranging between 10 and 70% of the sum of all of the cross sections of the lateral and bottom openings.

If the central axes of the lateral openings are downwardly inclined relative to the horizontal at an angle of between −10° and 50°, a good combined effect exerted by the lateral openings with the bottom openings will be obtained.

Preferably, the cross sections of the, lateral openings increase in the flow direction and the sum of the exit cross sectional areas of all of the lateral and bottom openings is equal to, or larger than, 1.1 times the interior cross sectional area of the immersed casting tube, measured on the level of the upper edge of the lateral openings.

A smooth uniform lateral flow is obtained if the upper limiting surfaces of the lateral openings are inclined at an angle a of between $-20° \leqq \alpha \leqq 35°$ and the lower limiting surfaces of the lateral openings are inclined at an angle $\beta$ of between $-30° \leqq \beta \leqq 60°$, relative to the horizontal.

Preferably, the lower limiting surfaces are designed to be longer than the upper limiting surfaces of the lateral openings and, by their extension, extend into the interior of the immersed casting tube, whereby a portion of the flow oriented downwardly within the immersed casting tube is trapped while avoiding a back-up and is directed aside.

According to a preferred embodiment, the central axes of the bottom openings, in addition to being oriented towards the narrow sides of the strand, are arranged to be inclined in the direction towards the wide sides of the strand, enclosing an angle of between −20° and +20° with the central axis of the immersed casting tube in that direction.

In order to conduct the melt into the lateral and bottom openings with backup losses as low as possible, the cross section of the interior of the tube section of the immersed casting tube advantageously increases in the flow direction and in the direction towards the narrow sides of the strand and decreases in the direction towards the wide sides of the strand. Therein, the cross sectional area of the interior of the tube section of the immersed casting tube suitably is constant in the flow direction or the cross sectional area of the interior of the tube section of the immersed casting tube increases in the flow direction.

Other advantages and features of the present invention will be apparent from the following description, drawings and claims.

BRIEF DESCRIPTION OF THE DRAWINGS

FIG. 1 is a vertical cross-sectioned view through an immersed casting tube inserted into a continuous casting mold and includes the flow conditions of the melt;

FIG. 9 is a partial cross-sectioned view similar to the bottom of FIG. 2 of a third embodiment of the bottom opening of the tube;

FIG. 10 is a partial cross-sectioned view similar to FIG. 9 of a fourth embodiment of the bottom openings of the tube; and FIG. 11 is a partial cross-section view similar to FIG. 9 of a fifth embodiment of the bottom opening of the tube.

DESCRIPTION OF THE PREFERRED EMBODIMENTS

Figures 2, 3, 4, 5, 6, 7, 8:
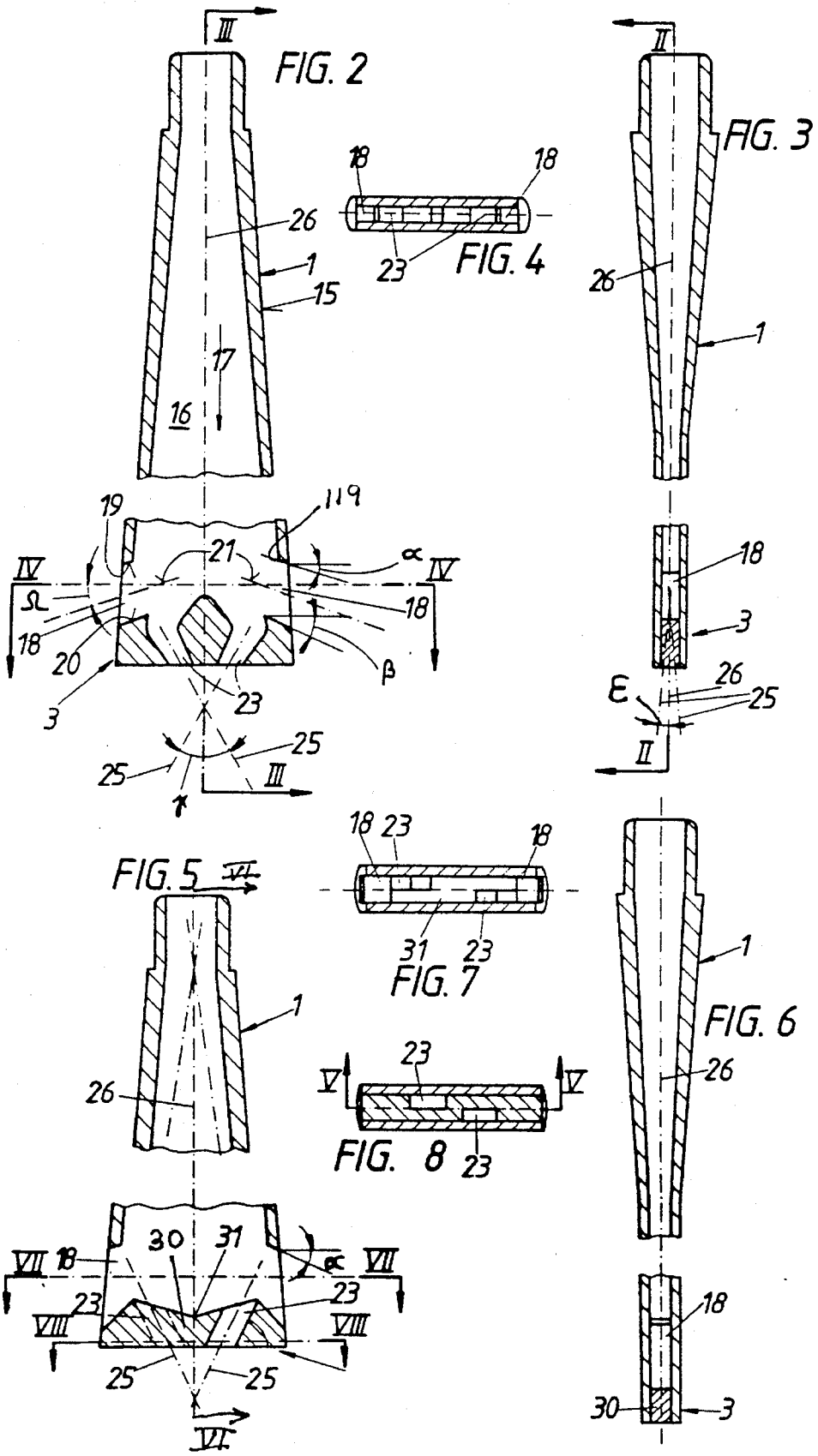
FIG. 2 is a cross-sectioned view of a fine embodiment of the immersed casting tube of the present invention taken along line II—II of FIG. 3.
FIG. 3 is a cross-sectioned view taken along line III—III of FIG. 3.
FIG. 4 is a cross-sectioned view taken along line IV—IV of FIG. 2.
FIG. 5 is a cross-sectioned view of a second embodiment of the immersed casting tube taken on line V—V of FIG. 8.
FIG. 6 is a cross-sectioned view taken on line VI—VI of FIG. 5.
FIG. 7 is a cross-sectioned view taken on line VII—VII of FIG. 5.
FIG. 8 is a cross-sectioned view taken on line VIII—VIII of FIG. 5.

The principles of the present invention are particular useful when incorporated into an immersed casting tube 1 of FIG. 1 which in inserted into a bottom of a tundish 2. A bottom portion or end 3 of the tube 1 iS inserted into a continuous casting mold 4, which according to FIG. 1, has a rectangular cross section adapted to cast a strand 5 having the cross section of a thin slab (having a dimension of approximately 70 mm×1500 mm). The continuous casting mold 4 accordingly comprises narrow side or end walls 6 and wide side walls 7, on which the narrow sides 8 and the wide sides 9 of the strand 5 are formed.

The mouth portion or bottom portion 3 of the immersed casting tube 1 reaches into the continuous casting mold 4 to a point or position below a surface 10 of a molten metal 11 (steel melt). The surface 10 of the metal melt 11 is covered by a casting powder 12. On the mold walls 6, 7, a still thin strand skin 13 forms, within which there is the liquid core 14 of the strand 5.

As is clearly apparent, in particular from FIGS. 2 to 4, the immersed casting tube 1 has a vertically directed tube section 15 defining an interior 16. This interior 16 has a cross section whose dimensions oriented parallel to the wide side walls 7 of the continuous casting mold 4 increase in the casting direction 17, yet decrease in a direction perpendicular thereto, i.e., parallel to the narrow side or end walls 6. The interior 16 changes from an approximately circular or square cross section adjacent to a narrow rectangular or oval cross section, adjacent the bottom portion 3 of the immersed casting tube 1. However, the cross sectional area of the interior remains largely constant, or increases slightly along a casting direction 17.

Near the bottom portion 3, the immersed casting tube 1 has two lateral openings 18 for the metal melt, with one directed at each of the narrow side walls 6 of the continuous casting mold 4 or narrow side 8 of the strand 5. The lateral openings 18 have upper and lower limiting surfaces 19, 20. The upper limiting surfaces 19 enclosing an angle $\alpha$ of between −20° and 35° to a horizontal and the lower limiting surfaces 20 enclosing an angle $\beta$ of between −30° and 60°, relative to the horizontal. Downwardly inclined limiting surfaces 19, 20 as illustrated in FIG. 2 are preferred and the cross sections of the lateral openings 18 increases in the flow direction. The central axes 21 of the lateral openings 18, i.e., the resultant from the flow lines (=main flow direction) of the casting jets 22 (FIG. 1) streaming out of the lateral openings 18 are downwardly inclined at an angle $\Omega$ of between −10° and 50° relative to the horizontal.

The lower limiting surface 20 of each of the side wall openings 18 is designed to be longer than the upper limiting surface 19 and the lower limiting surfaces 20 extends into the interior 16 of the immersed casting 1 tube by this extension. Thus, a major portion of the metal melt streaming downwards in the interior 16 is trapped and directed to the lateral openings 18.

In the bottom portion 3 of the immersed casting tube 1, at least two bottom openings 23 are provided to form at least two casting jets 24. The bottom openings 23 are oriented obliquely towards the narrow sides 8 of the strand 5. Central axes 25 of the bottom openings 23 intersects at an angle $\gamma$ of between 5° and 120°. The central axes 25 could also intersect in a skew manner.

The sum of the exit cross sectional areas of the lateral openings 18 and of the bottom openings 23 is equal to, or larger than, 1.1 times the cross sectional area of the interior of the immersed casting tube, measured on the upper edge (point 119) of the lateral openings. 18.

As is apparent, in particular from FIG. 3, the central axes 25 of the bottom openings 23, in addition to being oriented towards the narrow side walls 6 of the continuous casting mold 4, could be arranged so as to be inclined also in the direction towards the wide side walls 7 of the continuous casting mold 4. The projection of the central axis 26 of the central axes 25 of the bottom openings 23 to a plane extending parallel to the narrow sides 8 indicates an angle $\epsilon$ of between −20° and +20°. Also in that case, the central axes 25 of the casting jets 24 emerging from the bottom openings 23 may intersect or cross in a skew manner so that the casting jets 24 still coincide only by a portion of their cross sectional areas.

The cross sections of the bottom openings 23 comprise an area portion ranging between 10 and 70% of the sum of all of the cross sections of the lateral openings 18 and the bottom openings 23.

The immersed casting tube 1 functions in the following manner:

The combination of lateral openings 18 from which no crossing or intersecting casting jets 22 emerge and of bottom openings 23 ejecting intersecting jets 25 or jets 25 crossing askew is particularly relevant to the casting of strands 5 having thin-slab cross sectional formats at a high casting rate.

On account of the lateral openings 18 the desirable upper whirls 27 (FIG. 1) are formed and cause a satisfactory melting of the casting powder 12 applied onto the bath surface 10. A boundary wave 28, which is formed, has a small height due to the reduced lateral ejection pulses.

Since the downwardly oriented jets 24 either unite into a strongly fanning-out and dissipative mixed jet 29 or, in case of the skew crossing of the central axes of the casting jets, the jet 24 gives off energy to a rotational movement brought about by the crossing of the vertical immersion depth of the downwardly oriented casting jets 24 is low. In addition, the downwardly oriented casting jets 24 meet with the upward movement of the lower whirls produced by the lateral casting jets 22, whereby a flow pattern having large whirls in the lower mold region, which would result if only lateral openings were present, disintegrates into a flow pattern exhibiting small-whirl turbulences. Viewed over the width of the continuous casting mold 4, this means a uniform distribution of the flow speeds and hence also of the heat transmission to the already solidified strand skin 13 so that remelting of the same by new metal melt 11 entering into the continuous casting mold is avoided. Moreover, the pulse or impact on the strand skin 13 is much smaller therefore reduces the remelting of the strand skin 13 of the strand 5.

The hitherto frequently observed periodic migration of a surface wave from one mold half to the opposite one is reduced considerably by the configuration of the immersed casting tube 1 according to the invention, because the small-whirl structures forming below the immersed casting tube 1 dissipate more strongly, and therefore spread the exchange of energy over a large volume.

By the casting jets 24 emerging from the bottom portion 3 of the immersed casting tube 1 while crossing in a skew manner or intersecting, it is ensured that no casting jet, which reaches down is formed so that neither overheated steel nor nonmetallic particles penetrate farther into the interior of the strand than with an immersed casting tube having no bottom openings. Since the two lateral openings 18 convey a substantial volume portion in the direction towards the narrow ends 8 of the strand 5, the two usual whirls delimited by the immersed casting tube, the bath surface, the narrow sides 8 of the strand and the lateral casting jet are formed, which whirls ensure sufficient melting of the casting powder.

According to the embodiment of an immersed casting tube 1 represented in FIGS. 5 to 8, the central axes 25 of the casting jets 24, which emerge from the bottom region 3, cross in a skew manner so that the casting jets 24 intersect or contact each other below the bottom region 3 by their peripheral rim regions only. The central portion 30 of the bottom portion 3 provided between the bottom openings 23 forms a wedge-shaped depression 31 in the interior 16 of the immersed casting tube 1.

According to the embodiment represented in FIG. 9, of a bottom portion of an immersed casting tube, the central portion 30 of the bottom portion 3 provided between the two bottom openings 23 is extended upwardly in a wedge-shaped manner, thus improving the deflection of the metal melt 11 streaming downwards in the interior 16 of the immersed casting tube 1 towards the lateral openings 18 and also towards the bottom openings 23. Thus, back-up losses can be largely avoided.

According to the embodiment represented in FIG. 10, the two casting jets 24 emerging from the bottom portion 3 already partially intersect within the bottom portion 3. This will make feasible the advantageous adjustment of the spreading range below the bottom region of the thus formed mixed jet in view of certain casting conditions.

Also with an immersed casting tube having bottom openings 23 with central axes 25 intersecting in a skew manner, as illustrated, for instance, in FIG. 5, a part 32 (FIG. 11), that is upwardly extended in a wedge-shaped manner, may be provided instead of the central depression 31 (FIG. 5) in order to conduct the flow without losses.

Although various minor modifications may be suggested by those versed in the art, it should be understood that I wish to embody within the scope of the patent granted hereon all such modifications as reasonably and properly come within the scope of my contribution to the art.

I claim:

1. In an immersed casting tube provided for a continuous casting mold having wide side walls and narrow side walls and adapted to form a strand having broad sides and narrow sides, said strand including a thin slab, said immersed casting tube intended to introduce a metal melt into the continuous casting mold, said immersed casting tube including a tube section having a tube section interior and provided with lateral openings for said metal melt, said lateral openings having central axes oriented substantially towards the narrow sides of the strand, and a bottom portion provided with a bottom opening means for said metal melt, the improvement comprising the bottom opening means provided in said bottom portion having at least two bottom openings oriented obliquely towards the narrow sides of the strand and configured to form at least two casting jets having flow directions crossing each other in a viewing direction taken perpendicular to the wide sides of the strand.

2. In an immersed casting tube according to claim 1, wherein said casting jets emerging through said bottom openings intersect each other in said viewing direction.

3. In an immersed casting tube according to claim 2, wherein said casting jets emerging through said bottom openings intersect each other in the region of said bottom portion.

4. In an immersed casting tube according to claim 3, wherein said casting jets emerging through said bottom openings intersect each other only with a partial region of their cross sections.

5. In an immersed casting tube according to claim 2, wherein said casting jets emerging through said bottom openings intersect each other at a distance below said bottom portion.

6. In an immersed casting tube according to claim 5, wherein said casting jets emerging through said bottom openings intersect each other only with a partial region of their cross sections.

7. In an immersed casting tube according to claim 1, wherein said casting jets emerging through said bottom openings cross each other in a skew manner.

8. In an immersed casting tube according to claim 7, wherein said casting jets emerging through said bottom openings cross each other in a skew manner in the region of said bottom portion.

9. In an immersed casting tube according to claim 7, wherein said casting jets emerging through said bottom openings cross each other in a skew manner below the region of said bottom portion.

10. In an immersed casting tube according to claim 1, wherein said central axes of said bottom openings enclose an angle of between 5° and 120° in said viewing direction.

11. In an immersed casting tube according to claim 1, wherein said lateral openings have lateral opening cross sections and said bottom openings have bottom opening cross sections, said bottom opening cross sections comprising an area portion ranging between 10 and 70% of the sum of all areas of said lateral opening cross sections and bottom opening cross sections.

12. In an immersed casting according to claim 1, wherein said central axes of said lateral openings are downwardly inclined at an angle of between −10° and 50° relative to the horizontal.

13. In an immersed casting tube according to claim 1, wherein said lateral openings have lateral opening cross sections increasing in the flow direction.

14. In an immersed casting tube according to claim 13, wherein said lateral openings have upper limiting surfaces inclined at a angle of between −20° and 35° and lower limiting surfaces inclined at an angle of between −30° and 60°, relative to the horizontal.

15. In an immersed casting tube according to claim 14, wherein said lower limiting surfaces are designed to be longer than said upper limiting surfaces of said lateral openings so as to comprise an extension extending into said tube section interior of said immersed casting tube.

16. In an immersed casting tube according to claim 1, wherein central axes of said bottom openings, in addition to being oriented towards said narrow sides of said strand are arranged so as to be inclined in the direction towards said wide sides of said strand enclosing an angle of between −20° and +20° with a central axis of said immersed casting tube in the direction towards said wide sides of said strand.

17. In an immersed casting tube according to claim 1, wherein said tube section interior of said immersed casting tube has a cross section increasing in the flow direction and in the direction towards said narrow sides of the strand and decreasing in the direction towards said wide sides of the strand.

18. In an immersed casting tube according to claim 17, wherein said tube section interior of said tube section of said immersed casting tube has a cross sectional area that is constant in the flow direction.

19. In an immersed casting tube according to claim 17, wherein said tube section interior of said tube section of said immersed casting tube has a cross sectional area increasing in the flow direction.

20. In an immersed casting tube according to claim 1, wherein said lateral openings have upper edges and said tube section interior of said immersed casting tube has a first cross section on the level of said upper edges of said lateral openings and a sum of exit cross sectional areas of all of the lateral and bottom openings in equal to 1.1 times the area of said first cross section of said tube section interior.

21. In an immersed casting tube according to claim 1, wherein said lateral openings have upper edges and said tube section interior of said immersed casting tube has a first cross section on the level of said upper edges of said lateral openings and a sum of the exit cross sectional areas of all of the lateral and bottom openings is larger than 1.1 times the area of said first cross section of said tube section interior of said immersed casting tube.

* * * * *